US008721504B2

(12) United States Patent
Wang

(10) Patent No.: US 8,721,504 B2
(45) **Date of Patent: *May 13, 2014**

(54) CUSHIONING MECHANISM OF A TREADMILL

(76) Inventor: Leao Wang, Taichung (TW)

( * ) Notice: Subject to any disclaimer, the term of this patent is extended or adjusted under 35 U.S.C. 154(b) by 365 days.

This patent is subject to a terminal disclaimer.

(21) Appl. No.: 13/197,733

(22) Filed: Aug. 3, 2011

(65) Prior Publication Data

US 2013/0035214 A1 Feb. 7, 2013

(51) Int. Cl.
*A63B 22/02* (2006.01)

(52) U.S. Cl.
USPC ..... 482/54; 482/51; 196/843

(58) Field of Classification Search
USPC ..... 482/26–29, 51–56; 119/700; 198/843
See application file for complete search history.

(56) References Cited

U.S. PATENT DOCUMENTS

| | | | | |
|---|---|---|---|---|
| 6,328,676 | B1 * | 12/2001 | Alessandri | 482/54 |
| 6,749,542 | B2 * | 6/2004 | Wu et al. | 482/54 |
| 7,001,312 | B2 * | 2/2006 | Alessandri et al. | 482/54 |
| 7,077,788 | B2 * | 7/2006 | Chang | 482/54 |
| 7,563,205 | B2 * | 7/2009 | Alling | 482/54 |
| 2002/0010055 | A1 * | 1/2002 | Dyer et al. | 482/54 |
| 2003/0073545 | A1 * | 4/2003 | Liu et al. | 482/54 |
| 2005/0107220 | A1 * | 5/2005 | Wang | 482/54 |
| 2006/0287163 | A1 * | 12/2006 | Wang | 482/54 |
| 2009/0088301 | A1 * | 4/2009 | Alling | 482/54 |
| 2011/0312472 | A1 * | 12/2011 | Piaget et al. | 482/52 |
| 2012/0270704 | A1 * | 10/2012 | Wang | 482/54 |

* cited by examiner

*Primary Examiner* — Loan Thanh
*Assistant Examiner* — Gregory Winter

(57) ABSTRACT

A cushioning mechanism of a treadmill is interposed with an auxiliary plate between a base frame and the running board. The cushioning mechanism includes two hanging support pieces, two hanging swing pieces, and a flexible elastic element. When the running board is subject to a downward force and sinks, the flexible elastic element will be pulled and expanded externally. When the external force is eliminated, the running board will be returned back to its original position by the self-restoring ability of the flexible elastic element. In this way, an expected and optimal cushioning effect is achieved.

2 Claims, 5 Drawing Sheets

CUSHIONING MECHANISM OF A TREADMILL

BACKGROUND OF THE INVENTION

1. Fields of the Invention

The invention relates to a cushioning mechanism of a treadmill, and more particularly, to a structure employing the excellent restoring ability of a flexible elastic element in conjunction with a synchronous swing of a hanging device adapted to the flexible elastic element to compensate the expansion displacement for achieving an excellent cushioning effect.

2. Description of the Related Art

It is well-known that the cushioning effect of the conventional treadmills is mostly created by a plurality of rubber pads between the running board and the treadmill's base frame. In this way, these rubber pads provide a certain cushioning effect to properly withstand all reactive forces acting on the treadmill's operator when the running board is subject to an external force.

These rubber pads may produce the cushioning effect to some extent. However, it is an indisputable fact that they can be qualitatively changed due to the environmental and time factors. In particular, their durability tends to be different according to forces acting thereon. That is, their service life will be significantly impaired in case of the prolonged exposure to large pressure.

Moreover, the rubber pads are positioned in a hidden place. When they are repaired or replaced, the running belt and the running board have to be removed. Therefore, it is not easy for the general users to conduct the above-mentioned complicated steps. This requires further improvements.

SUMMARY OF THE INVENTION

An object of the invention is to provide a cushioning mechanism for a treadmill that employs a flexible elastic element with an excellent responsiveness, a great restoring ability, and a high tolerance to replace most of the rubber pads. Moreover, a hanging device movable with the flexible elastic element is used to absorb the displacement of the flexible elastic element when subject to an external force. In this way, an excellent cushioning effect is achieved. In addition, when the flexible elastic element is required to be replaced, it is only necessary to remove the continuous moving belt for conducting the replacement work. As a result, a convenient replacement is ensured.

According to the invention, at least one set of the cushioning mechanism of a treadmill is interposed with an auxiliary plate between a base frame and the running board. The cushioning mechanism includes two hanging support pieces, two hanging swing pieces, and a flexible elastic element. When the running board is subject to a downward force and sinks, the flexible elastic element will be pulled and expanded externally. When the external force is eliminated, the running board will be returned back to its original position by the self-restoring ability of the flexible elastic element. In this way, an expected and optimal cushioning effect is achieved.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 5:
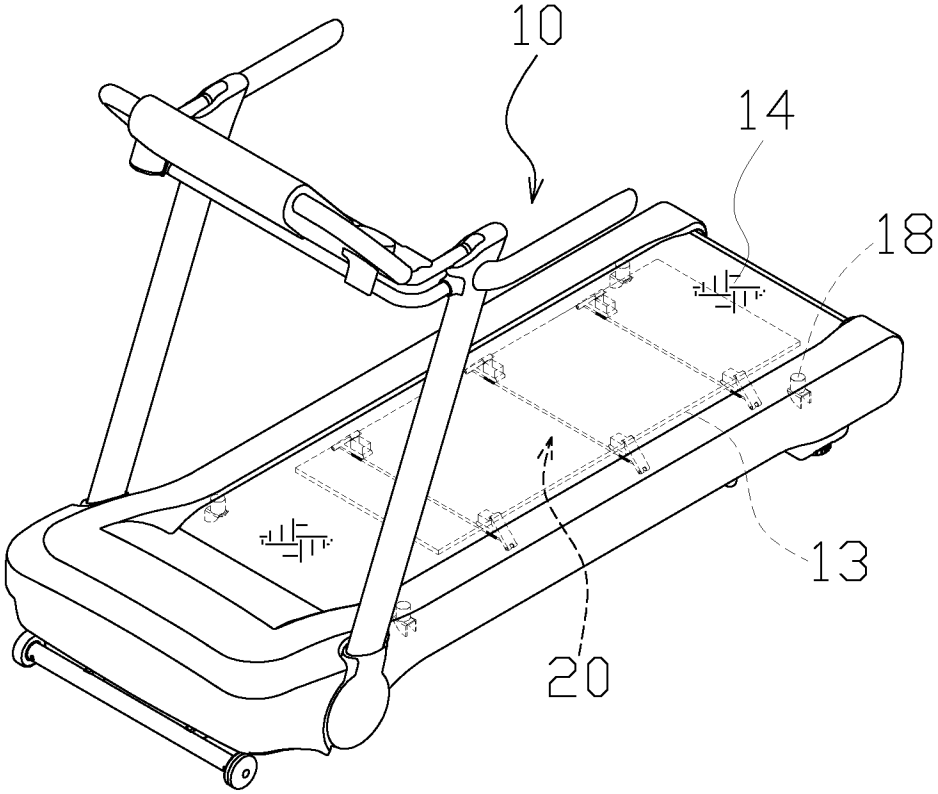
FIG. 5 is a perspective view of the invention in an assembly position.

Referring to FIG. 5, the cushioning mechanism 20 according to the invention is installed in a hidden way under a running board 12 of the treadmill 10. A continuous moving belt 14 is positioned around the running board 12. The drawing of FIG. 5 is used to illustrate the installation position of the invention.

Figure 1:
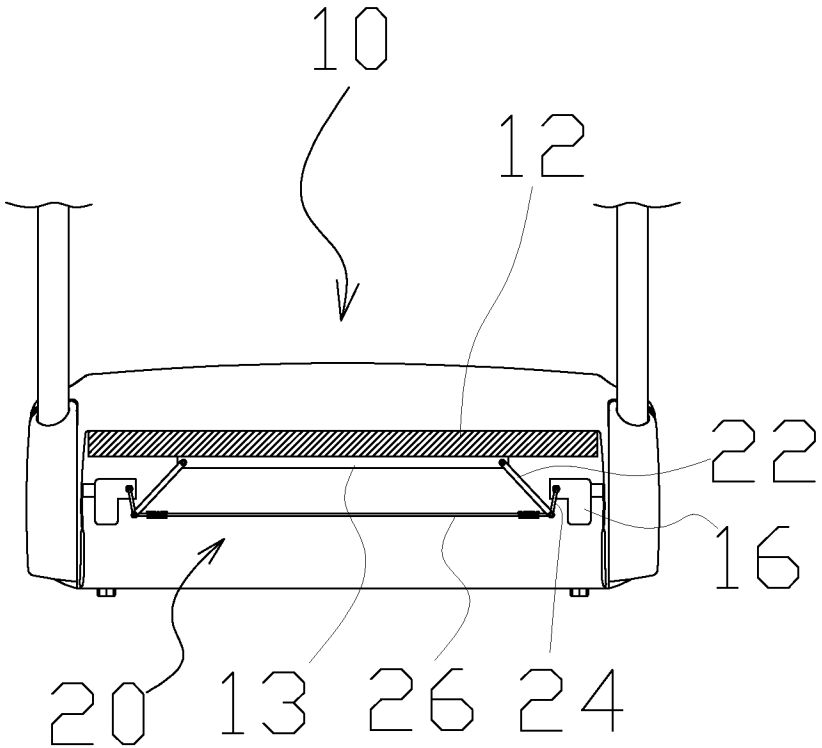
FIG. 1 is a schematic view of a preferred embodiment of the invention.
Figure 2:
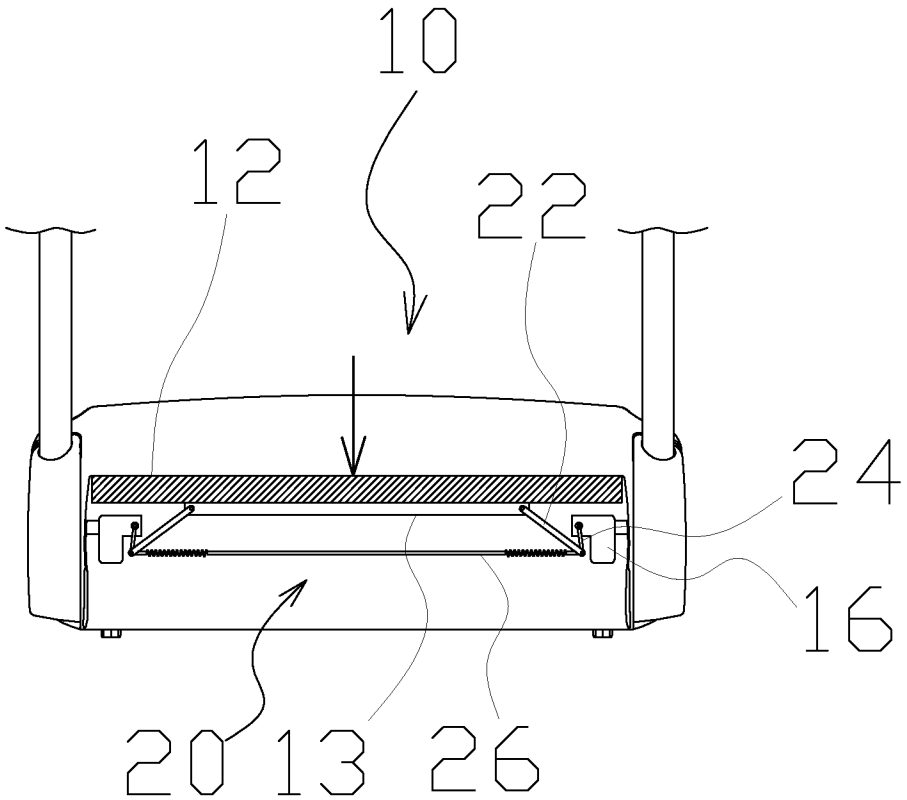
FIG. 2 is a schematic view of the structure according to FIG. 1 with a force acting thereon.

As shown in FIGS. 1 and 2, at least one set of the cushioning mechanism 20 is interposed between a base frame 16 and the running board 12. An auxiliary plate 13 is positioned at the bottom of the running board 12. The cushioning mechanism 20 includes two hanging support pieces 22, two hanging swing pieces 24, and a flexible elastic element 26.

The hanging support pieces 22 each have one end pivotably coupled to the auxiliary plate 13 and the other end pivotably connected to the hanging swing pieces 24.

The hanging swing pieces 24 are pivotably coupled in a hanging way to the base frame 16 with the bottom end pivotably connected to the flexible elastic element 26.

Both sides of the flexible elastic element 26 are connected to the hanging swing pieces 24, respectively.

Based on the assembly of the above-mentioned components, when the running board 12 is subject to a downward force and sinks, the flexible elastic element 26 mounted below will be pulled and expanded externally. The expansion displacement of the flexible elastic element 26 will be compensated by the swing effect of the hanging support pieces 22 and the hanging swing pieces 24. When the external force is eliminated, the running board 12 will be returned back to its original position by the self-restoring ability of the flexible elastic element 26. In this way, an expected and optimal cushioning effect is achieved.

Figure 3:
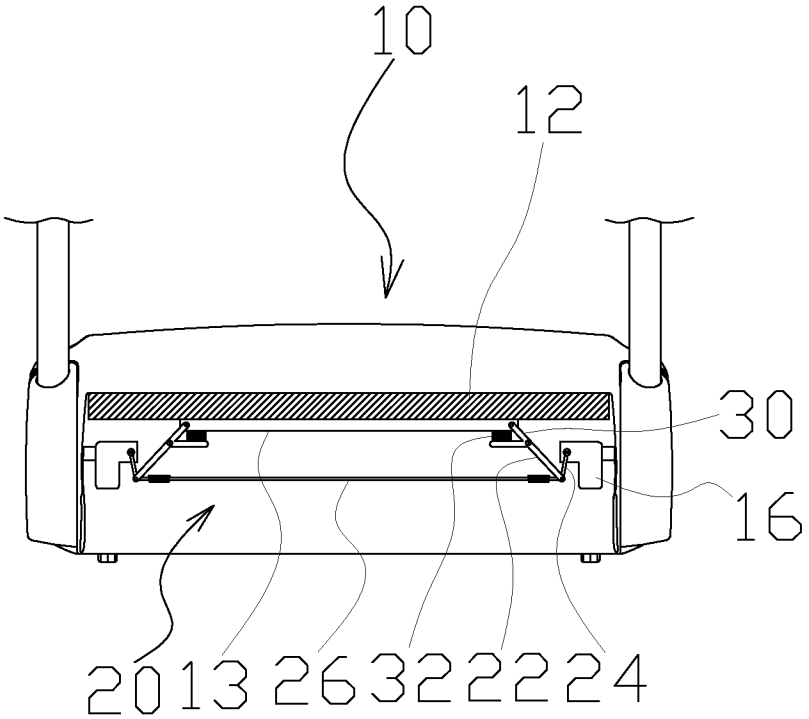
FIG. 3 is a schematic view of another preferred embodiment of the invention.
Figure 4:
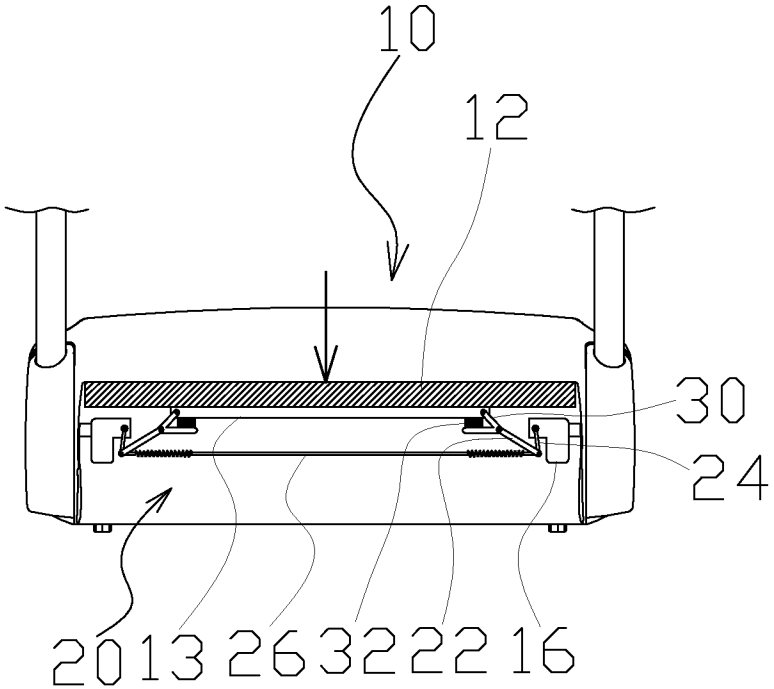
FIG. 4 is a schematic view of the structure according to FIG. 3 with a force acting thereon.

As shown in FIGS. 3 through 5, a clamping rod 30 having a soft pad 32 is pivotably coupled between the auxiliary plate 13 and the hanging support pieces 22 in such a way that the bottom of the auxiliary plate 13 rests against the soft pad 32. In this way, the impact force acting on the all components can be minimized.

As shown in FIG. 5, conventional rubber pads 18 are also mounted (at four corners) between the running board 12 and the base frame 16. They tend to work with the cushioning mechanism 20 of the invention to achieve a double cushioning effect.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A cushioning mechanism of a treadmill, comprising:

the treadmill including:

a base frame;

a running board located beneath the base frame;

at least one cushioning mechanism, wherein the cushioning mechanism is interposed between the base frame and the running board; and an auxiliary plate positioned at the bottom of the running board, wherein the cushioning mechanism includes two hanging support pieces, two hanging swing pieces, and a flexible elastic element, wherein the hanging support pieces each have one end pivotably coupled to the auxiliary plate and the other end pivotably connected to the hanging swing pieces, wherein the hanging swing pieces are pivotably coupled in a hanging way to the base frame with the bottom end thereof pivotably connected to the flexible elastic element, and wherein both sides of the flexible elastic element are connected to the hanging swing pieces, respectively, whereby, when the running board is subject to a downward force and sinks, the flexible elastic element mounted below will be pulled and expanded externally, and the expansion displacement of the flexible elastic element will be compensated by the swing effect of the hanging support pieces and the hanging swing pieces, and when the external force is eliminated, the running board will be returned back to its original position by the self-restoring ability of the flexible elastic element such that an expected and optimal cushioning effect is achieved.

2. The cushioning mechanism of a treadmill as recited in claim 1, wherein a clamping rod having a soft pad is pivotably coupled between the auxiliary plate and the hanging support pieces in such a way that the bottom of the auxiliary plate rests against the soft pad.

* * * * *